US008468957B2

(12) United States Patent
Ruiz et al.

(10) Patent No.: US 8,468,957 B2
(45) Date of Patent: Jun. 25, 2013

(54) MULTI-ORIENTATION STACKING RISER

(75) Inventors: Milton D. Ruiz, Germantown, TN (US); Sandy Felsenthal, Memphis, TN (US)

(73) Assignee: Whitmor, Inc., South Haven, MS (US)

( * ) Notice: Subject to any disclaimer, the term of this patent is extended or adjusted under 35 U.S.C. 154(b) by 0 days.

(21) Appl. No.: 13/179,390

(22) Filed: Jul. 8, 2011

(65) Prior Publication Data

US 2013/0009030 A1 Jan. 10, 2013

(51) Int. Cl.
*A47B 7/00* (2006.01)

(52) U.S. Cl.
USPC ..... 108/91; 446/128

(58) Field of Classification Search
USPC .... 108/91, 92, 144.11, 53.1, 53.3; 248/188.2, 248/346.11, 677; 446/128
See application file for complete search history.

(56) References Cited

U.S. PATENT DOCUMENTS 2,933,850 A * 4/1960 Martin ..... 248/188.2
3,487,579 A * 1/1970 Brettingen ..... 446/128
3,877,170 A * 4/1975 Bakker ..... 446/128
4,744,780 A * 5/1988 Volpe ..... 446/128
4,964,834 A * 10/1990 Myller ..... 446/128
5,615,429 A * 4/1997 Williams ..... 5/509.1
5,683,283 A * 11/1997 Glynn ..... 446/128
6,012,185 A 1/2000 Woods et al.
D420,062 S * 2/2000 Glickman ..... D21/504
6,086,444 A * 7/2000 Glickman ..... 446/128
D485,746 S * 1/2004 Abraham et al. ..... D8/374
6,892,991 B1 * 5/2005 Soh ..... 248/188.2
6,968,583 B1 11/2005 Rich
7,302,778 B2 * 12/2007 MacMillan ..... 52/169.9
D661,575 S * 6/2012 Ruiz et al. ..... D8/374

* cited by examiner

*Primary Examiner* — Jose V Chen

(74) *Attorney, Agent, or Firm* — Husch Blackwell LLP; H. Frederick Rusche

(57) ABSTRACT

A multi-orientation stacking riser includes a main section; a protruding mating section extending from one surface of the main section; and a recessed mating section formed in an opposite surface of the main section, and wherein the recessed mating section accommodates insertion of a protruding mating section of an identical stacking riser in at least first and second positions.

7 Claims, 3 Drawing Sheets

MULTI-ORIENTATION STACKING RISER

TECHNICAL FIELD OF THE INVENTION

The present invention relates generally to the field of furniture accessories and, more particularly, to an improved apparatus for raising the level of an item.

SUMMARY OF THE INVENTION

One aspect of the invention generally pertains to an improved apparatus for raising the level of a piece of furniture to a desired height.

Another aspect of the invention pertains to a riser component that may be combined and stacked with other identical components and oriented in variable directions to create a unique decorative appearance.

In accordance with the above aspects of the invention, there is provided a multi-orientation stacking riser that includes a main section; a protruding mating section extending from one surface of the main section; and a recessed mating section formed in an opposite surface of the main section, and wherein the recessed mating section accommodates insertion of a protruding mating section of an identical stacking riser in at least first and second positions.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
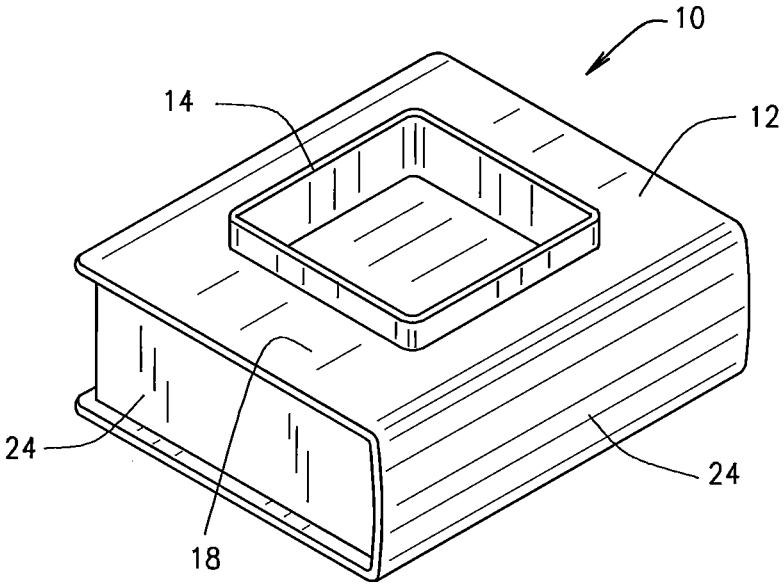
FIG. 1 is a top perspective view of a multi-orientation, stacking riser according to one exemplary embodiment of the present invention.
Figure 2:
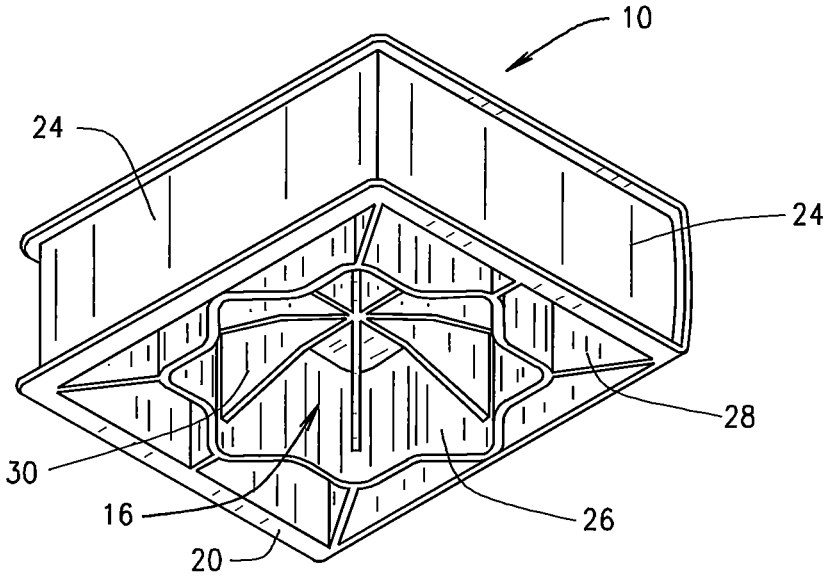
FIG. 2 is a bottom perspective view of the riser of FIG. 1.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

FIGS. 1-6 illustrate a multi-orientation, stacking riser 10 according to an exemplary embodiment of the present invention. In pertinent part, the riser 10 includes a main section 12, a protruding mating section 14, and a recessed mating section 16. In the preferred embodiment, the foregoing sections are integrally formed with one another, for example by injection molding same. The main section 12 provides the primary supporting body for the riser 10. The protruding 14 and recessed 16 mating sections cooperate with the recessed and protruding, respectively, mating sections of one or more other risers to securely mount one riser on top of another in one of a multiple of respective orientations of the risers.

The protruding mating section 14 extends from a top surface 18 of the main section 12. In the illustrated embodiment of FIGS. 1-6, the protruding mating section 14 is provided with square outer dimensions. The outer dimensions of the protruding mating section 14 are sized in a manner to cooperate with the recessed mating section 16 as discussed below.

The recessed mating section 16 is advantageously formed in a bottom surface 20 of the main section 12 opposite to the top surface 18. The references to top and bottom surfaces herein are used solely for the purposes of illustration and to describe the general basic positional relationship between the protruding 14 and recessed 16 mating surfaces. The positioning of the protruding 14 and recessed 16 mating sections is not limited to the top and bottom surfaces of the main section 12 depending upon the manner of application of the riser 10.

The recessed mating section 16 is formed by a depression in the bottom surface 20 of the main section 12, and, thus, the recessed mating section 16 extends into the interior of the main section 12. In the case of the illustrated embodiment, the interior of the main section 12 includes a series of ribs that extend from outer walls 24 of the main section 12 toward the middle of the interior of the main section 12. The ribs lend structural support to the main section 12 of the riser 10 while minimizing the weight of the riser 10 and the amount of material required to form the riser 10.

The recessed mating section 16 is formed by a geometric rib 26 that is formed in a shape that is complementary to the outer dimensions of the protruding mating section 14. In the illustrated, preferred embodiment, the geometric rib 26 is provided in the form of an eight-pointed "star" that is centered with the interior of the main section 12. The geometric rib 26 is connected with interior top surface 18 of the main section 12. It is further connected with one or more of the side walls of the main section 12 either directly or by means of first support ribs 28. The geometric rib 26 may also be supported by a series of second support ribs 30 that extend within the geometric rib 26 from one side to the other. Both the geometric rib 26 and the first support ribs 28 extend to the bottom surface 20 of the main section 12. In contrast, the second support ribs 30 located within the geometric rib 26 do not extend entirely to the bottom surface 20. Those of skill in the art will recognize that the bottom surface 20 in this context is not a solid surface but rather the plane formed by the bottom edges of the outer walls 24 of the main section 12.

The difference in height between the geometric rib 26 and the second support ribs 30 creates a recess so that the second support ribs 30 do not interfere with the positioning of the protruding mating section 12 within the recessed mating section 16 defined by the geometric rib 26 and, furthermore, help define a depth of the recessed mating section 16 to help control how far the protruding mating section 12 extends into the recessed mating section 16. In a preferred embodiment, the difference in height between the geometric rib 26 and the second support ribs 30 is approximately equal to a height of the protruding mating section 14. In this manner, two stacked risers 10 will contact one another both at a junction of the bottom of the outer walls 24 with the top surface 18 and a junction of the top of the protruding mating section 14 with the bottom of the second support ribs 30, resulting in increased stability and strength of the stacked risers.

Figure 3:
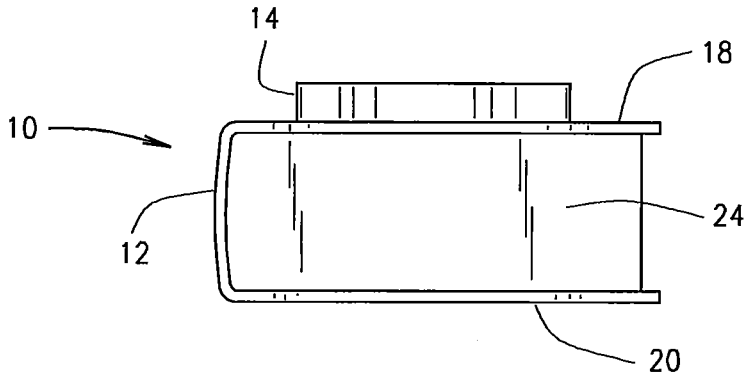
FIG. 3 is a side view of the riser of FIG. 1.
Figure 4:
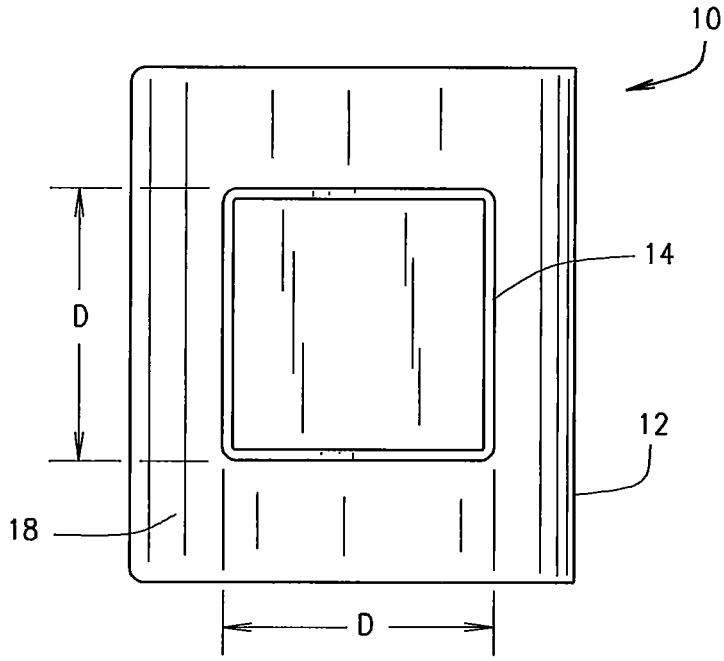
FIG. 4 is a top view of the riser of FIG. 1
Figure 5:
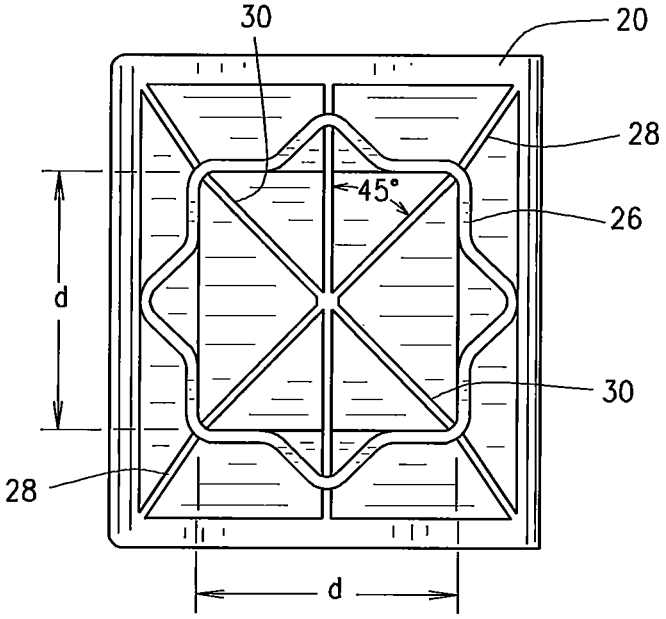
FIG. 5 is a bottom view of the riser of FIG. 1.

The relationship between the protruding mating section 14 and recessed mating section 16 will now be described in more detail. It will be seen that the outer dimension D of the protruding mating section 14 corresponds, with a tolerance for clearance and for manufacturing variances, to the inner dimension d of the recessed mating section 16 to allow insertion of the protruding mating section 14 into the recessed mating section 16. As illustrated in FIGS. 3 and 4, the dimensions D and d of the protruding mating section 14 and recessed mating section 16, respectively, are consistent around both of these sections. Therefore, the protruding mating section 14 and recessed mating section 16 may be rotated relative to one another while still allowing insertion of the protruding mating section 14 into the recessed mating section 16. More particularly, the shape of the recessed mating section 16 allows for discrete forty-five degree) (45°) rotations—and subsequent insertions—of the protruding mating section 14 of one riser relative to the recessed mating section 16 of another riser.

Figure 6:
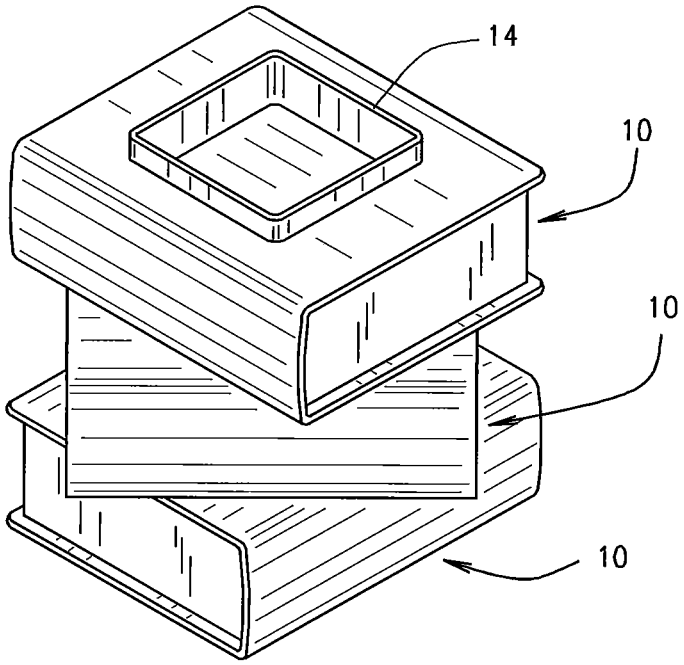
FIG. 6 is a perspective view of a series of stacked risers according to another embodiment.

One advantage in the ability to readily vary the orientation of one riser relative to another can be seen in FIG. 6. In the illustrated embodiment, each individual riser is molded in the form of a hard back book; other shapes also being suitable for the risers. By varying the relative positioning of one riser to another, differing appearances of stacked books supporting a bed or other piece of furniture can be created.

In a preferred embodiment, the riser 10 is injection molded from a suitable plastic material. While the illustrated embodiment of the riser 10 is provided with a series of ribs for internal support of the main section 12 and forming of the recessed mating section 16, it is also contemplated within the scope of the invention for the main section 12 to be formed from a solid block of material with the recessed mating section 16 being a depression in the otherwise solid block.

While the preferred embodiment has been illustrated with a protruding mating section 14 and recessed mating section 16 in the described shapes, other embodiments may utilize other complementary shapes. For example, the protruding mating section 14 and recessed mating section 16 may each be provided in the shape of a circle, which would allow a greater range of relative angular adjustment of the stacked risers.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

What is claimed is:

1. A multi-orientation stacking riser, comprising:

a main section having a first central vertical axis and a first cross-sectional shape;

a protruding mating section extending from a first surface of said main section, said protruding mating section having a second cross-sectional shape and having a second central vertical axis; and a recessed mating section formed in a second, opposite surface of said main section, said recessed mating section having a third cross-sectional shape and having a third central vertical axis;

wherein said third cross-sectional shape is different than said second cross-sectional shape and at least one of said second or said first cross-sectional shapes is different than said first cross-sectional shape;

wherein said second and third central vertical axes are in alignment with said first central vertical axis;

wherein said recessed mating section accommodates insertion of a protruding mating section of an identical stacking riser in at least first and second positions such that the stacked risers have a first outer profile when said protruding mating section of said identical stacking riser is inserted into said recessed matin section in said first position and a second outer rtical profile when said protruding mating section of said identical stackin riser is inserted into said recessed matin section in said second position, said first and second outer profiles being different from one another.

2. The multi-orientation stacking riser as set forth in claim 1, wherein said first and second positions relate to one another by rotation of said protruding mating section of said identical stacking riser relative to said recessed mating section by an angle of less than ninety degrees.

3. The multi-orientation stacking riser as set forth in claim 1, wherein said first and second positions relate to one another by rotation of said protruding mating section of said identical stacking riser relative to said recessed mating section by an angle of forty-five degrees or less.

4. The multi-orientation stacking riser as set forth in claim 1, wherein said main section is molded in the form of a hard back bound book.

5. The multi-orientation stacking riser as set forth in claim 4, wherein said first outer profile presents the appearance of books stacked in a first arrangement and wherein said second outer profile presents the appearance of books stacked in a second arrangement that is different than said first arrangement.

6. The multi-orientation stacking riser as set forth in claim 1, wherein said protruding mating section comprises a first height;

wherein said recessed mating section comprises a geometric rib defining said second cross-sectional shape and at least one support rib within said geometric rib; and further comprising a height differential between said geometric rib and said support rib, wherein said height differential is equal to said first height.

7. The multi-orientation stacking riser as set forth in claim 1, wherein said second cross-sectional shape is a square and said third cross-sectional shape is an eight-pointed star.

* * * * *

UNITED STATES PATENT AND TRADEMARK OFFICE

CERTIFICATE OF CORRECTION

PATENT NO. : 8,468,957 B2
APPLICATION NO. : 13/179390
DATED : June 25, 2013
INVENTOR(S) : Milton D. Ruiz It is certified that error appears in the above-identified patent and that said Letters Patent is hereby corrected as shown below:

In the Claims:
Col. 4, line 20, delete "matin" and replace with --mating--
Col. 4, line 21, delete "rtical" and replace with --vertical--
Col. 4, line 22, delete "stackin" and replace with --stacking--
Col. 4, line 23, delete "matin" and replace with --mating--

Signed and Sealed this
Eighth Day of October, 2013

Teresa Stanek Rea

Teresa Stanek Rea
*Deputy Director of the United States Patent and Trademark Office*